US012162674B2

(12) United States Patent
Morales Serrano et al.

(10) Patent No.: US 12,162,674 B2
(45) Date of Patent: Dec. 10, 2024

(54) CONTAINER, DEVICE AND METHOD FOR STORING OR PROCESSING PARTICULATE MATERIALS TO MINIMIZE OR ELIMINATE VIBRATIONS SUCH AS QUAKING OR SHAKING

(71) Applicants: HYL TECHNOLOGIES, S.A. DE C.V., De Los Garza (MX); DANIELI & C. OFFICINE MECCANICHE S.P.A., Buttrio (IT)

(72) Inventors: Raul Morales Serrano, Monterrey (MX); Stefano Maggiolino, San Pedro Garza Garcia (MX); Luis Manuel Becerra Lucatero, Monterrey (MX); Alessandro Martinis, Pozzuolo Del Friuli (IT); Andrea Tavano, Tavagnacco (IT)

(73) Assignees: HYL TECHNOLOGIES, S.A. DE C.V., San Nicolas de los Garza Nuevo Leon (MX); DANIELI & C. OFFICINE MECCANICHE, S.P.A., Buttrio (IT)

( * ) Notice: Subject to any disclaimer, the term of this patent is extended or adjusted under 35 U.S.C. 154(b) by 1045 days.

(21) Appl. No.: 16/978,491

(22) PCT Filed: Mar. 8, 2018

(86) PCT No.: PCT/IB2018/051503
§ 371 (c)(1),
(2) Date: Sep. 4, 2020

(87) PCT Pub. No.: WO2019/171146
PCT Pub. Date: Sep. 12, 2019

(65) Prior Publication Data
US 2021/0016959 A1 Jan. 21, 2021

(51) Int. Cl.
*B65D 88/28* (2006.01)
*B65D 88/54* (2006.01)

(52) U.S. Cl.
CPC ..... *B65D 88/28* (2013.01); *B65D 88/54* (2013.01)

(58) Field of Classification Search
CPC ..... B65D 88/28; B65D 88/54; B65D 88/64; B65D 88/542
See application file for complete search history.

(56) References Cited

U.S. PATENT DOCUMENTS 829,493 A * 8/1906 Thurston
3,010,620 A * 11/1961 Folse ..... B65G 69/10 193/29

(Continued)

FOREIGN PATENT DOCUMENTS

CN 2876056 * 3/2006
CN 101592436 12/2009

(Continued)

OTHER PUBLICATIONS

International Search Report for PCT/IB2019/051503, mailed Aug. 7, 2018, 5 pages.

(Continued)

*Primary Examiner* — Brian E Glessner
*Assistant Examiner* — Daniel J Kenny
(74) *Attorney, Agent, or Firm* — Nixon & Vanderhye P.C.

(57) ABSTRACT

A container with lower vibrations, such as quaking and shaking as well as noise effects, known also as hooting, honking or howling, and an effective and cost-competitive method and device to decrease such phenomena during the discharge of granular material particles from silos, hoppers, bins, reactors and in general containers for storing or processing such granular material particles. The container (Continued)

includes at least one baffle that is attached to the container wall, in the lower portion or at the bottom of the tapered discharge part of said container, protruding towards the central axis of its tapered discharge part. The baffle forms a stagnant zone in the bed of the granular material particles in contact with the container wall whereby the particles in that zone flow under the friction against other particles instead of the friction between the particles and the wall.

21 Claims, 7 Drawing Sheets

(56) References Cited

U.S. PATENT DOCUMENTS

| | | | | | |
|---|---|---|---|---|---|
| 3,459,411 | A | | 8/1969 | Jacobs | |
| 4,255,130 | A | | 3/1981 | Johnson, Jr. | |
| 4,790,111 | A | * | 12/1988 | Johinke | B65G 65/365 222/149 |
| 4,795,266 | A | * | 1/1989 | Johanson | B01F 25/83 222/564 |
| 4,821,861 | A | * | 4/1989 | Shanahan | B65G 11/083 193/25 E |
| 4,960,229 | A | * | 10/1990 | Dumbaugh | F23G 5/444 222/161 |
| 5,211,319 | A | * | 5/1993 | Reinholdsson | B65D 88/28 414/328 |
| 5,769,281 | A | * | 6/1998 | Bates | B65D 88/64 222/196 |
| 6,213,762 | B1 | | 4/2001 | Eichberger et al. | |
| 6,409,790 | B1 | * | 6/2002 | Calderon | C21B 13/14 75/378 |
| 6,871,457 | B2 | * | 3/2005 | Quintero-Flores | B65D 88/28 52/197 |
| 7,581,905 | B2 | * | 9/2009 | Berggren | B65G 53/22 406/90 |
| 9,469,473 | B2 | * | 10/2016 | Thiessen | B65D 88/28 |
| 9,522,778 | B2 | * | 12/2016 | Southwell | B65D 90/587 |
| 10,370,732 | B2 | * | 8/2019 | Voelker | C21B 13/004 |
| 2011/0014020 | A1 | * | 1/2011 | Thiessen | B65G 65/46 414/326 |
| 2013/0153368 | A1 | | 6/2013 | Tsuge et al. | |

FOREIGN PATENT DOCUMENTS

| | | |
|---|---|---|
| CN | 103029045 | 4/2013 |
| CN | 205204139 | 5/2016 |
| DE | 1 907 147 | 9/1970 |
| EP | 1801036 | 6/2007 |
| KR | 10-2012-0073663 | 7/2012 |
| WO | 97/30915 | 8/1997 |

OTHER PUBLICATIONS

Written Opinion of the ISA for PCT/IB/3019/051503, mailed Aug. 7, 2018, 11 pages.

* cited by examiner

CONTAINER, DEVICE AND METHOD FOR STORING OR PROCESSING PARTICULATE MATERIALS TO MINIMIZE OR ELIMINATE VIBRATIONS SUCH AS QUAKING OR SHAKING

RELATED APPLICATION

This application is the U.S. national phase of International Application PCT/IB2018/051503 filed Mar. 8, 2018, which designated the U.S. and is hereby incorporated by reference.

FIELD OF THE INVENTION

The invention relates to the field of containers where granular material particles are stored or processed such as silos, hoppers, bins, reactors, product coolers and shaft furnaces, where said granular material particles are stored and/or chemically treated, heated or cooled, sometimes in contact with a variety of reactive gases as fixed or moving packed beds or which are temporarily stored and therefore must be periodically charged and discharged. In one of its aspects, the invention relates to a cost-competitive and effective method and a device to decrease vibrations such as shaking and quaking in a container for producing or cooling pellets of direct reduced iron (hereinbelow equally identified as direct reduced iron, or DRI) during the flow of said granular DRI material through said container.

BACKGROUND OF THE INVENTION

In the steelmaking industry, among others, a wide variety of granular material particles, such as metallized iron pellets (DRI), are processed, handled, stored and transported. The process vessels, bins, hoppers, silos and in general containers for storing and/or processing DRI pellets and lumps or mixtures thereof, are designed for efficient material flow and competitive capital and operation costs. To facilitate the description of the invention, in this application the term container will mean to cover all different forms of storage or processing containers for bulk particulate DRI where said bulk DRI is introduced at the upper part of the container and flows downwardly through a lower discharge tapered portion generally of inverted conical, pyramidal or wedge form, converging to at least one outlet at the bottom of said container.

Currently, the design of containers for storing or processing bulk granular material particles is based in theoretical studies of the flow properties of said materials and empirical criteria developed over the experience of particulate solids flow behavior during charge and discharge of the containers. In general, these containers are designed with a geometry intended to avoid the material free flow problems such as bridging, arching, rat-holing, channeling and to induce what is called "mass flow" meaning that all granular material particles within the container are in motion as a moving bed when the container is discharged. Promoting mass flow is a main engineering objective in designing bulk material containers aiming to produce a product of uniform quality. Stagnant zones of granular material in the container are eliminated as much as possible because the material may undergo undesired reactions or deterioration.

A number of variables affect the patterns of movement of granular material particles within the containers, for example, particle size distribution, inter-particles cohesion tendency, inter-particle friction forces and also friction between the granular material particles and the container wall. The dimensions of the outlet and the angle and geometry of the tapered discharge portion of the container determine whether the flow pattern will be "mass flow" or the so-called "funnel flow". "Funnel flow" or "core flow" develops when the central portion of the solid granular material particles bed flow first through the outlet opening while the granular material particles proximate to the hopper walls flow at lower velocity or remain stagnant because of the friction forces between the granular material particles and the walls and to the holding force of the converging walls on said granular material particles. Funnel flow produces a shear boundary between the granular material particles that flow at higher velocity and the granular material particles that flow at lower velocity or are stationary close to the hopper walls.

The technical problem addressed by the present invention is that the interaction of the granular material particles e.g. for example DRI pellets and/or lumps, moving downwardly by gravity, and the container walls, no matter if designed and built for "mass flow" or "funnel flow", causes that the containers vibrate, shake or quake, and these vibrations cause damages to the containers, their supporting structures and associated piping connected thereto, given that in large industrial plants, the mass of DRI material inside said containers being processed and moving or discharged from these containers weighs hundreds of tons.

The following publications were found regarding vibration and noise of containers storing particulate materials are described below:

PCT Patent application No. WO 97/30915 describes a process and device for reducing the dynamic effects and noise during the discharge of bulk material from a silo. The rate of flow of the bulk material in the neighborhood of the wall can be reduced by means of forming a macroscopic roughness on the wall. This roughness is produced in the silo wall by attaching lining plates to the inner wall of the silo having a variety of projections, perforations, mesh configurations, etc. to produce the macroscopic roughness in relation to the granular material particles size. The lining plates are attached in the cylindrical part of the silo leaving the conical portion without any modification. This publication does not recognize the shaking or quaking problem of a container during the bulk material discharge. Implementing this proposal for decreasing the sound during discharge of silos entails a high cost due to installation of the rough plates and the maintenance thereof due to the continuous erosion of granular material particles flow over its surface and the risk of fall of said plates with the corresponding problems of fouling or stopping the discharge if carried down by the particulate material. This publication does not disclose or suggest any modification to the discharge portion of a silo. Additionally, this method cannot be implemented in containers producing or handling DRI at high temperature, because the main body, where the rough plates are set of said containers is lined with a refractory and insulating material layers.

EP Patent No. 1 801 036 describes the use of baffles installed in the inner side wall of a bulk material silo to avoid noises and vibrations during its emptying. These baffles form an inwardly inclined surface which directs the flow of solid particles towards the center of the silo and create compaction zones distributed along the vertical portion of the silo. The inclined surface of the baffles may be formed for example by conical rings or half-pipe rings. The baffles divide the flow volume of bulk material into a plurality of compaction and expansion zones and thereby change the natural frequency of the silo and reduce the noises and vibrations caused by the granular material particles sliding over the silo wall. The baffles of this patent are located in the main body of the silo and this publication does not teach or suggest any modification to the discharge part of the silo or location of any baffles in the conical discharge part. Additionally, the baffles of this patent are intended to promote the flow of granular material particles proximate to the wall, therefore the upper surface of the baffles is not flat but inclined, since the effect of the baffles is to divide the bed of granular material particles into several zones. This publication expressly teaches away of having flat baffles and stagnant zones thus avoiding static zones to prevent deposition of granular material particles in the wall region.

Documents cited in this description (including the foregoing patents), and all documents cited or referenced in the documents cited in this text, are incorporated herein by reference.

The present invention provides a method, a container and a device which solve the problems of the prior art in an effective and lower-cost way and that may be retrofitted in existing hoppers, silos, reactors, shaft furnaces, etc. for gas-solid treatment of granular materials such as bulk iron ore and DRI pellets.

In contrast with the prior art teachings, applicants have found that by forming a flat surface that forms a stagnant zone of granular material particles in contact with the container wall reduces the shaking phenomena. Without linking in anyway the scope and spirit of the invention to any theory, it is thought that the flat surface formed by the ring-shaped baffle of the invention causes that the DRI granular material particles resting on the baffle remain stagnant and form a stagnant zone over the container wall while the rest of DRI granular material particles slide down against the static DRI granular material particles subject to the inter-particle friction instead of the friction due to the interaction of the DRI granular material particles with the container wall.

The stagnant zone may be formed for example by attaching a ring-shaped baffle in a zone proximate to the conical portion outlet whereby the quaking or shaking of said container is significantly decreased and even eliminated.

A ring-shaped baffle may be located at any height within the conical part of the container, preferably at a point proximate to the discharge outlet or precisely at the discharge outlet of said container. The ring-shaped baffle may be retrofitted to existing containers in a practical way by fixing it to the internal wall of the lower tapered or conical wall of the discharge part or inserting it right at the container outlet of the conical wall of the tapered discharge part within the flanges connecting the container to any discharge conduit leading the granular material particles to the a granular material particles flow regulating device or a discharge gate or a valve.

In an embodiment herein illustrated the invention is adapted to those containers producing, processing, cooling or storing granular materials containing iron oxides or direct reduced iron (DRI) bulk material in a wide range of temperatures, from ambient temperature to about 700° C., where the main body of said containers is lined with a refractory and/or insulating lining. The present invention also provides other advantages in the operation of DRI reactors and coolers, for example a lower generation of fines which is an important parameter of quality for the utilization of the DRI in steelmaking. A further benefit derived from the application of this invention in containers for abrasive granular material particles, such as DRI, is that the stagnant zones formed by baffles lower the wearing rate of the container wall because the particles flow against other particles and not in contact with said wall.

There is still a need of a cost-competitive and effective method and apparatus to decrease vibrations, such as quaking and shaking as well as noise effects, known also as hooting, honking or howling, during the discharge of granular materials from silos, hoppers, bins, reactors and in general containers for storing or processing such granular materials, and in particular for containers of large industrial hoppers, bins, including shaft-type reactors for producing DRI and DRI coolers in the steel industry.

SUMMARY AND OBJECTS OF THE INVENTION

It is an object of the present invention to provide a new method to decrease the dynamic effects of moving solid granular material particles in storage or process bulk materials containers, such as noise, quaking and shaking.

It is another object of the present invention to provide a container comprising a main body and lower tapered discharge part converging to a discharge outlet with decreased quaking, shaking or noise effects caused by movement of solid granular material particles flowing downwardly by gravity therein.

It is a further object of the present invention to provide a shaft-type moving bed reactor for producing DRI with decreased quaking, shaking or noise effects caused by movement of solid granular material particles flowing downwardly by gravity therein.

It is also an object of the present invention to provide a moving bed DRI cooler with decreased quaking, shaking or noise effects caused by movement of solid granular material particles flowing downwardly by gravity therein.

It is a further object of the present invention to provide a container for storing DRI with decreased quaking, shaking or noise effects caused by movement of solid granular material particles flowing downwardly by gravity therein.

Other objects of the invention will be pointed out or will be evident from the following description of the preferred embodiments and the accompanying drawings.

In some exemplary embodiments of the invention, a container comprising a main body for processing or storing a particulate material and a lower tapered discharge part converging to at least one outlet, said container also comprising a ring-shaped baffle installed in said tapered discharge part providing a circumferential flat surface projecting into the interior of said container which causes that a relatively small portion of said particulate material proximate and in contact to the wall of the container rests on said flat surface forming a stagnant zone above said device. The major portion of the granular material not proximate to the container wall flows through the central opening of said ring-shaped device to a lower portion of the container or a conduit having a cross section area larger than the area of the central opening of the ring-shaped baffle. The ring-shaped baffle may be attached, for example by welding, to the inner wall of the discharge downwardly converging part of the container or may be installed at the outlet of the container between any connecting flanges.

The invention also comprises a method to decrease vibrations and noise of containers having a main body for processing or storing a particulate material and a lower tapered discharge part converging to at least one outlet, wherein said method comprises providing a baffle that forms a stagnant zone of particulate material in contact to the wall of the container above said baffle in said tapered discharge part.

The invention can be equally adapted and applied to containers having cross sections other than circular, such as polygonal, rectangular, oval, or the like.

BRIEF DESCRIPTION OF THE DRAWINGS

FIG. 1 shows a diagrammatic view of a generic bulk material container, illustrating a first embodiment of the invention wherein a ring-shaped device is installed at the discharge outlet of said container.

FIG. 2 shows a diagrammatic upper plan view of the container of FIG. 1.

FIG. 3 shows a diagrammatic view of a generic bulk material container illustrating a second embodiment of the invention wherein a ring-shaped device is attached to the wall of the lower part of said container above the discharge outlet.

FIG. 4 shows a diagrammatic upper plan view of the container of FIG. 3.

FIG. 5 shows a diagrammatic view of a third embodiment of the invention within a generic bulk material container similar to FIGS. 1 and 3, wherein a plurality of ring-shaped baffles are attached at the bottom and to the wall of the lower part of said container above the discharge outlet.

FIG. 6 shows a diagrammatic upper plan view of the container of FIG. 5.

FIG. 7 shows a schematic plan view of another embodiment of the ring shaped baffle of invention where the cross section of the tapered discharge part of the bulk material container is of oval shape.

FIGS. 8 and 8*a* show a schematic upper plan view of another embodiment of the invention where the tapered discharge part of the bulk material container are either of rectangular or polygonal pyramidal shape.

FIG. 9 shows a schematic perspective diagram of a monolithic embodiment of the ring shaped baffle of the invention for applications at low temperature.

FIG. 10 shows a schematic perspective diagram of another embodiment of the ring shaped baffle of the invention formed by annular segmented portions for applications where said baffle is in contact with granular material particles at high temperature.

DESCRIPTION OF PREFERRED EMBODIMENTS OF THE PRESENT INVENTION

Although the invention is herein described as applied to a generic storage container of cylindrical body and conical tapered discharge part, and also an embodiment thereof is described of a process vessel for cooling DRI pellets by contact with a cooling gas circulating counter-currently to the continuous downward gravity flow of said DRI pellets, it will be understood that in its broader aspects the invention may also be applicable to other types of storage and process vessels or containers, silos, bins, hoppers, where a wide variety of granular materials are stored and/or processed, such as foodstuffs, grains, polymers, and granular material particles of products in many industrial processes.

Figure 1:
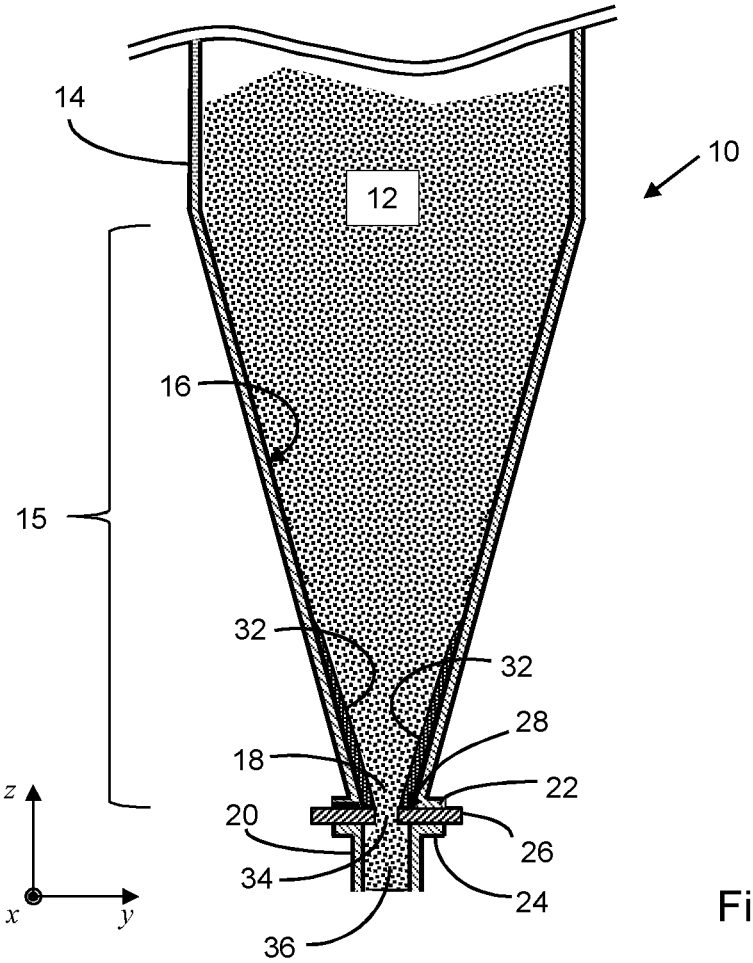
FIGS. 1 to 10 have been illustrated with reference to their relevant axes x, y and z and have been described in the detailed description in the same manner.
Figure 2:
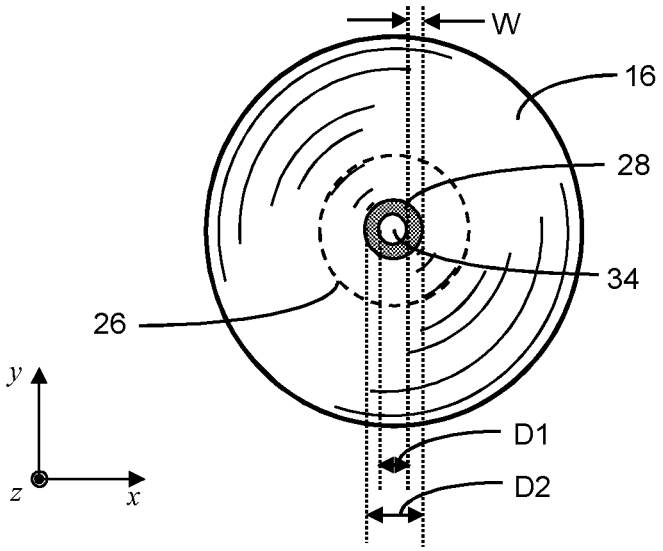

In one aspect of the invention and with reference to FIG. 1, a granular material container is provided with a baffle located at the bottom precisely at the outlet of the tapered discharge part.

Figure 3:
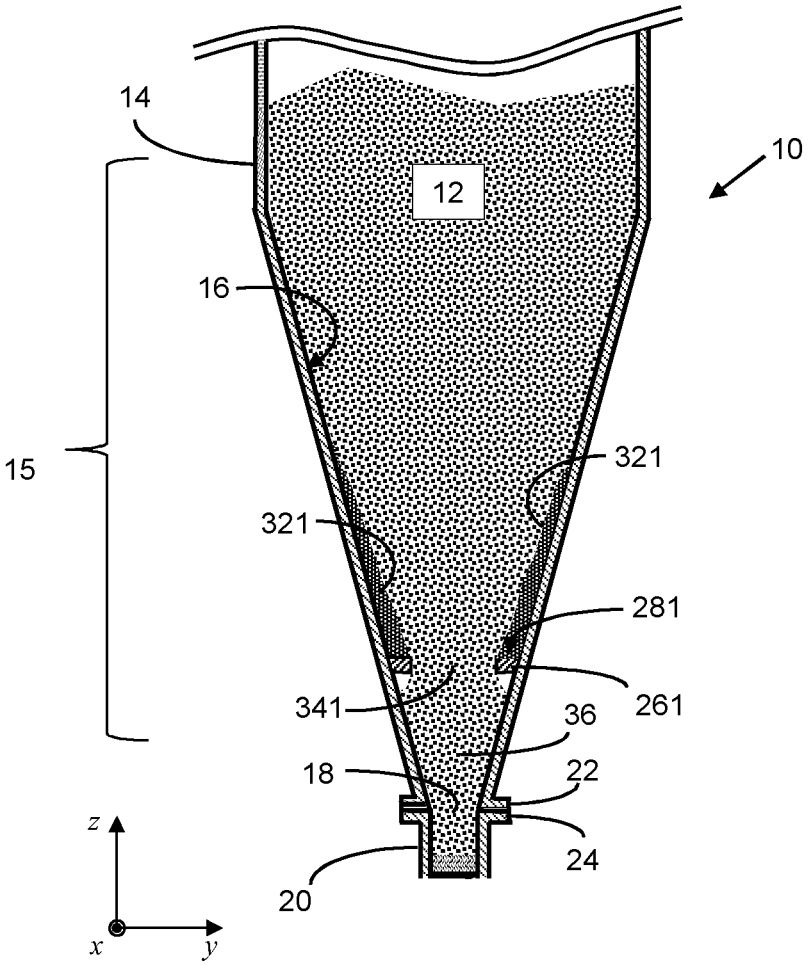
Figure 4:
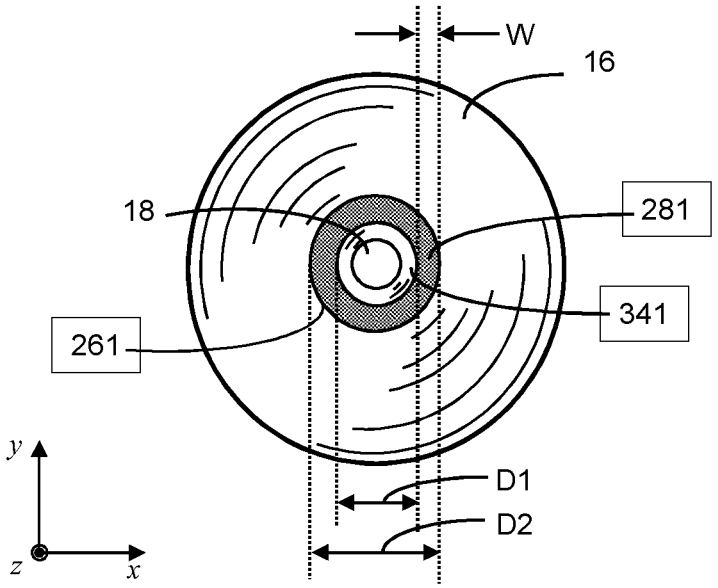

In another aspect of the invention and with reference to FIG. 3, a granular material container is provided with a baffle located above the outlet of the tapered discharge part.

Figure 5:
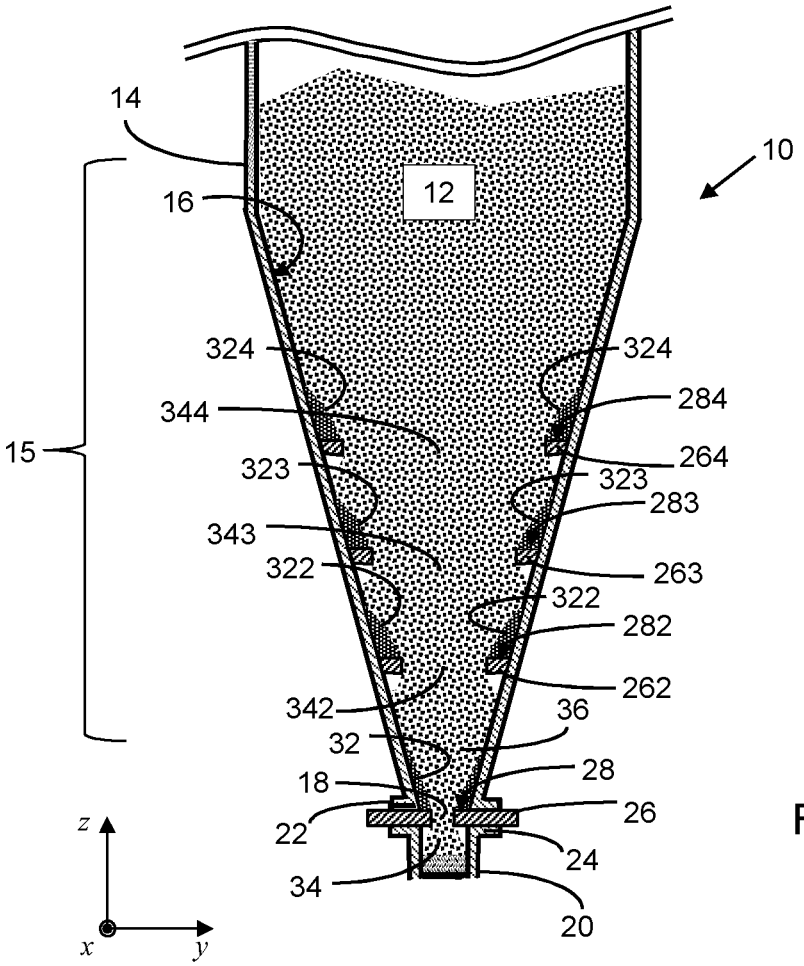
Figure 6:
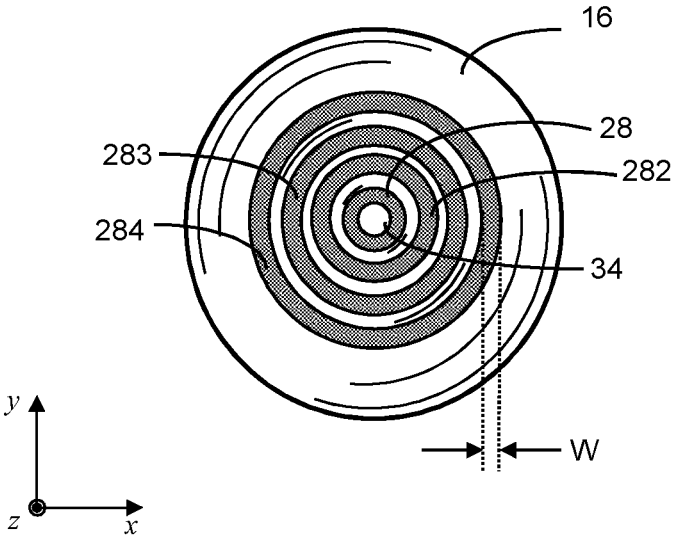

In a further aspect of the invention according to FIG. 5, a granular material container is provided with a plurality of baffles located both at the outlet of the tapered discharge part and also above the outlet of said tapered discharge part.

In another additional aspect of the invention, the baffle has the shape of an annular plate with an opening through which the granular material particles flow.

In another aspect of the invention, the baffle has the shape of an oval plate with an opening through which the granular material particles flow. The opening may have also an oval shape.

Figure 8:
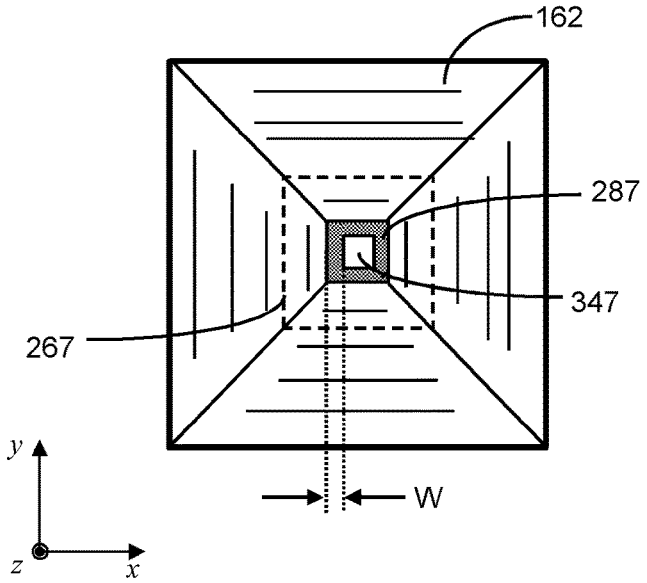

In another aspect of the invention according to FIG. 8, the baffle has the shape of a rectangular plate with an opening through which the granular material particles flow. The opening may have also a rectangular shape. In another aspect according to the preceding one, the baffle has the shape of a polygonal plate with an opening through which the granular material particles flow. The opening may have also a polygonal shape.

In other aspect of the invention, for applications in containers comprising a conical discharge part and granular material particles at high temperature, the baffle is formed by a plurality of annular segmented portions that can be separately attached to the container wall leaving a gap between each other to allow expansion and contraction of said sections due to temperature changes.

In another aspect of the invention, the baffle has the shape of a linear bar which is attached to the each flat side wall of the container.

In other aspect of the invention, for applications in containers comprising a pyramidal discharge part having rectangular or polygonal shape and where the granular material particles reach high temperatures, the baffle is formed by a plurality of linear segments that can be separately attached to the container wall leaving a gap between each other to allow expansion and contraction of said segments due to temperature changes.

Referring to FIGS. 1 to 6, numeral 10 generally designates a generic container wherein a bed of granular material particles 12 moves downwardly by gravity, herein illustrated as of cylindrical shape having a cylindrical body 14 and a tapered discharge part generally designated with 15 has a conical inner wall 16 converging to an outlet 18 having a diameter indicated as D2. The tapered discharge part 15 having the conical wall 16 connects to a discharge conduit 20 having the same or larger diameter or dimensions than said outlet 18 by means of suitable flanges 22 and 24.

According to an embodiment of the invention, a ring-shaped baffle 26 is inserted, for example between flanges 22 and 24, which protrudes a surface 28 in the periphery of the bottom of the tapered discharge part 15.

The surface 28 of ring-shaped baffle 26 stops the downward flow of the material particles that are proximate and in contact with the conical inner wall 16 of the tapered discharge part 15, thus forming a stagnant zone 32 above the area defining the outlet 18. The boundary between the stagnant zone 32 and the granular material particles 12 flowing down may extend upwardly to a certain height that will be defined by the values of friction inter-particles and the friction between particles and the conical inner surface 16 of the tapered discharge part 15.

The granular material particles 12 flow down through the central bottom opening 34 of the baffle 26, located below the outlet 18, and continue flowing through a discharge conduit 20. The flow area for the granular material of conduit 20 is larger than the diameter D1 of baffle 26, so that a partial flow restriction effect is produced by the baffle 26 on the flow of granular material particles 12 in the area designated with 36.

In another embodiment of the invention shown in FIG. 3, a baffle 261 is attached, for example by welding, or any suitable fastening means which will be apparent to the skilled expert, to the inner surface 16 of the tapered discharge part 15, well above the discharge outlet 18. The ring-shaped baffle 261 has a central bottom opening 341 which forms a surface 281 in the periphery of the conical wall 16 of the tapered discharge part 15. The granular material particles 12 flowing down through the central bottom opening 341 continue flowing through the rest of the conical wall 16 of the tapered discharge part 15, the outlet 18 and conduit 20.

As shown in FIGS. 1 to 6, the ring-shaped baffles 26, 261, 263 and 264 are located at a position proximate to the outlet 18, preferably within the lower half portion of the height of the conical inner wall 16 of the tapered discharge part 15 and protrudes inwardly in the direction towards the central axis of the tapered discharge part 15 up to a certain radial distance so that the boundary lines between the stagnant zones 32, 321, 322, 323 and 324 formed above said baffles 26, 261, 262, 263 and 264, and the bed of granular material particles 12 flowing down to the central openings 34, 341, 342, 343 and 344 extend upwardly to cover the zone of the bed where the friction of the granular material particles 12 and the conical inner wall 16 of the tapered discharge part 15 causes the shaking or quaking of the container.

In some embodiments, the ratio of the diameter of the central opening D1 of the baffles 26 261, 262, 263 and 264 to the diameter D2 of said conical wall 16 of the tapered discharge part 15 at the point where the ring-shaped baffle is located, is in the range between 0.4 to 0.95.

In some embodiments as shown for instance in FIGS. 2, 4, 6, 7 and 8, the width W of the baffle protruding inside the bed of the granular material particles 12 is in the range from 10 to 100 times the average size of said particles.

Referring to FIG. 5, an embodiment of the invention is shown wherein a baffle 26 is placed at the bottom of the conical part 16 and also a plurality of baffles are placed above the outlet 18 in the conical part 16, designated by 262, 263, and 264. This embodiment may be applicable in those cases where the friction of the granular material particles against the wall of the container causes quaking or shaking of said container at a larger zone above the outlet 18.

In other embodiments of the invention, the container 100 is a DRI reactor, where the gas 40 is a reducing gas at high temperature, in the range from 850° C. to 1100° C.

The invention can be equally adapted for other hoppers and containers of cross sections other than cylindrical, such as polygonal, rectangular, oval or the like. In containers of the other mentioned geometries, the baffle of the invention will follow the contour of the perimeter of the tapered discharge part at the position where said baffle is located.

Figure 7:
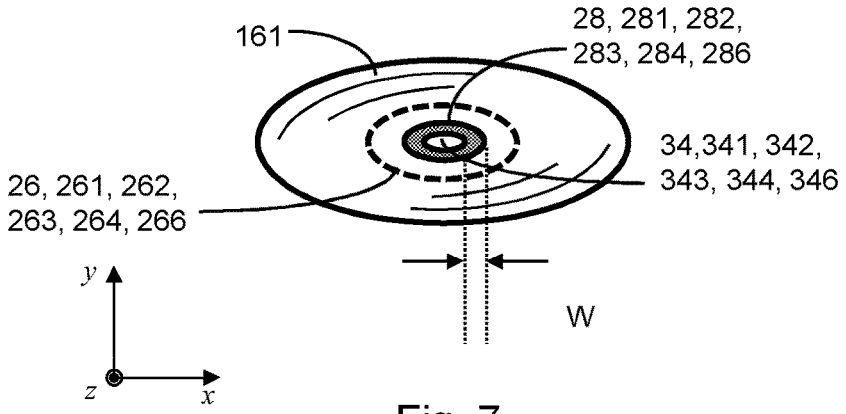

Referring to FIG. 7, a diagrammatic plan view of an embodiment of the invention is shown wherein the cross section of the tapered discharge part and its inner wall 161 has an oval shape. Equally the shape of the baffles 26, 261, 262, 263, 264, 266, the shape of the opening 34, 341, 342, 343, 344, 346 and finally the surface of the baffle 28, 281, 282, 283, 284, 286 may have the same shape according to this embodiment.

Referring to FIG. 8, a diagrammatic plan view of an embodiment of the invention is shown wherein the cross section of the tapered discharge part and its inner wall 162 have a rectangular shape. The baffles 267 (with the surface 287 forming the stagnant zone of material) and the bottom opening 347 have consequently the same rectangular shape of the container.

Figure 8A:
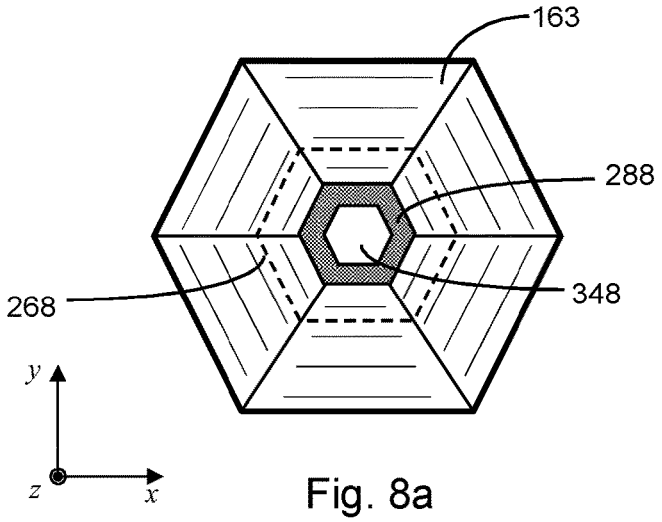

Referring to FIG. 8*a*, a diagrammatic plan view of an embodiment of the invention is shown wherein the cross section of the tapered discharge part and its inner wall 163 have a polygonal shape. The baffles 268 (with the surface 288 forming the stagnant zone of material) are then realized by linear segments by any suitable means known to the skilled expert. The bottom opening 348 has consequently the same shape of the container or baffles.

Figure 9:
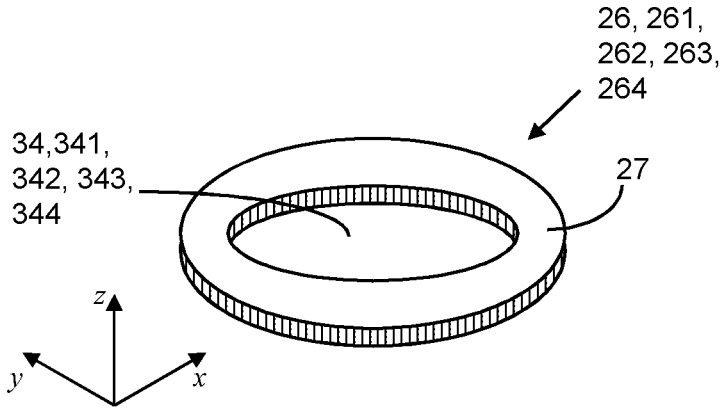

Referring to FIG. 9, a diagrammatic perspective view of a baffle 26, 261, 262, 263, 264 according to some embodiments of the invention is shown as a one-piece ring, typically made of steel, but it will be understood that said baffle may be made of any other suitable material as best fits for a particular application. The one-piece baffle 26, 261, 262, 263, 264, may be used in applications where the temperature changes of the granular material particles in contact with said baffle are not significant as to cause stresses or deformation of the baffle.

Figure 10:
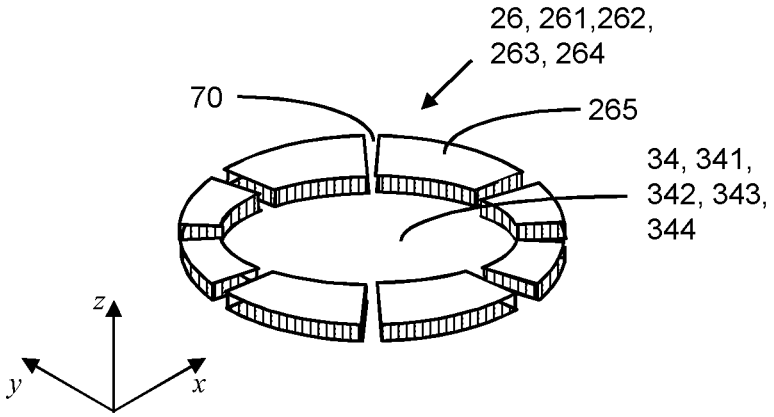

Referring to FIG. 10, for applications where the baffles 26, 261, 262, 263, 264, 266, and 269 are in contact with granular material particles at high temperatures, above about 100° C., for example when the baffle is used in DRI reactors or DRI coolers, where the particles in contact with said baffle may be in the range from 100° C. to 800° C., the baffle 26, 261, 262, 263, 264, 266 and 269 is formed by a plurality of annular segments 265 which may be attached to the inner wall 16 leaving spaces 70 between each other to allow expansion and contraction of the annular segments 265 due to changes in temperature. The number of annular segments may vary depending on the size and material of the baffle 26, 261, 262, 263, 264, 266 and 269. In some embodiments, the number of segments forming a baffle is 8.

It is also to be understood that, a segmented baffle as in FIG. 10 may be likewise applied to a linear segment, or linear segments, which can form a rectangular 267 or polygonal 268 baffle as in FIGS. 8 and 8*a*, where however for the sake of clarity of drawing a space between segments has not been illustrated.

Figure 11:
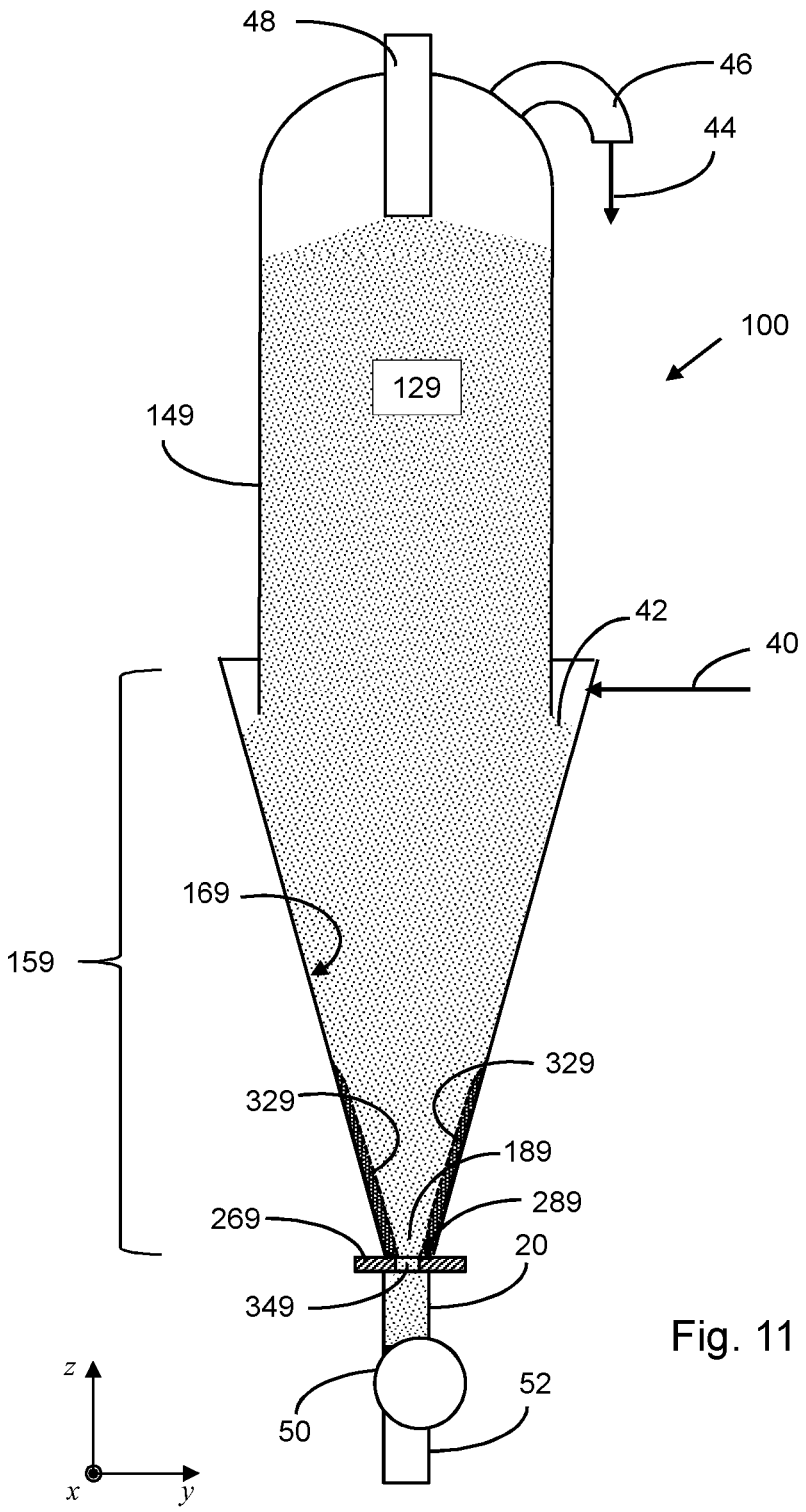
FIG. 11 shows a diagrammatic view of a DRI cooler or DRI reactor incorporating an embodiment of the device of the present invention.

Referring to FIG. 11, it is described another exemplary embodiment of the present invention, where it is shown a direct reduced iron (DRI) cooler 100. The direct reduced iron cooler 100 has, by way of example, a cylindrical upper part 149 where a bed of granular material particles 129 containing metallic iron are cooled by circulating a non-oxidizing gas 40 fed through a gas inlet 42. Hot cooling gas 44 is then withdrawn through a gas outlet 46. A bed of DRI granular material particles 129 are fed into the DRI cooler 100 at high temperature, in the range from about 400° C. to 800° C. through at least one conduit 48 and flow downwardly by gravity at a regulated rate by means of a regulating discharge device 50 for example a star-type rotary valve, a vibrating feeder or any other similar mechanism and are discharged at a lower temperature through conduit 52.

The DRI cooler 100 has a lower tapered discharge part 159 having an inner conical wall 169 converging to an outlet 189. Other mechanical components of the connections of the DRI cooler 100 with the discharge rate regulating mechanism and the discharge conduits, such as flanges and expansion joints are not shown for simplicity of the figure, however any appropriate combination of the elements described and specifically referenced in FIGS. 1 to 10 may be combined and used, as it will be apparent to the skilled expert in order to obtain and work the invention, in particular in reference to the most appropriate shape of the baffles, openings, dimensions and positioning within the container 100. In particular the baffle or baffles of the DRI cooler 100, due to the temperatures reached within the container may very well be those illustrated and described in FIG. 10.

In order to decrease the vibrations and quaking of the DRI cooler, a ring-shaped baffle 269 is placed at the bottom of the outlet 189 of the tapered discharge part 159, for example by means of suitable flanges (now shown). The ring-shape baffle 269 has the form of an annular plate with a central bottom opening 349 similarly to what has been described above for bottom openings 34 and 341 (in FIGS. 1 to 4) and which forms a flat surface 289 in the periphery of the conical wall 169 of the tapered discharge part 159 that prevents the pellets from flowing against the conical wall 169 of the tapered discharge part 159 forming a stagnant zone 329 of DRI granular material particles 129.

Figure 12:
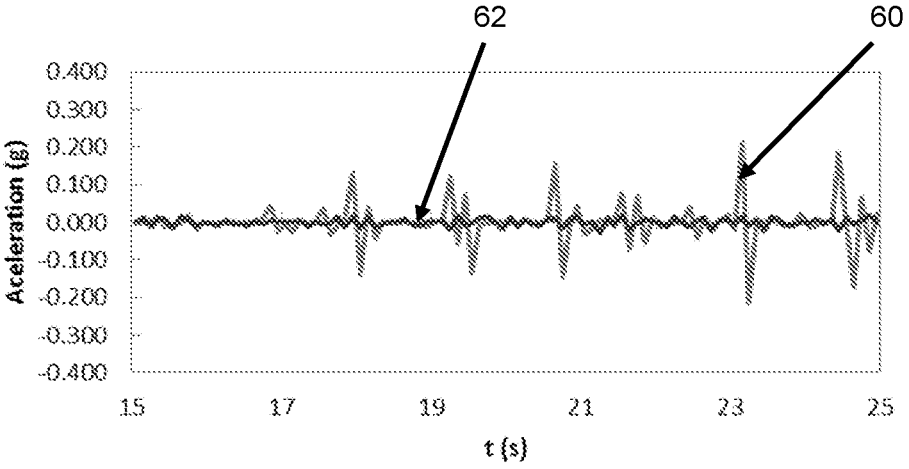
FIG. 12 shows a graph obtained by a computational simulator of the level of vibrations with and without the incorporation of a baffle according to the invention in a DRI shaft-type reactor.

As an example of the effectiveness of the invention in reducing the intensity of vibrations, FIG. 12 shows a graph of a comparison between the magnitude of the vibrations, measured in mm/s obtained by a computational simulator of the flow of granular material particles in a DRI shaft-type reactor with and without the installation of a baffle according to the invention. Line 60 indicates the level of vibrations measured as a fraction of the acceleration of gravity (g) of the DRI reactor versus time in seconds. The intensity of vibrations reach levels of about 0.2 (g) without utilizing a baffle according to the invention. Line 62 indicates the level of vibrations after incorporation of the baffle of the invention showing a significant change to values below about 0.02 (g).

Figure 13:
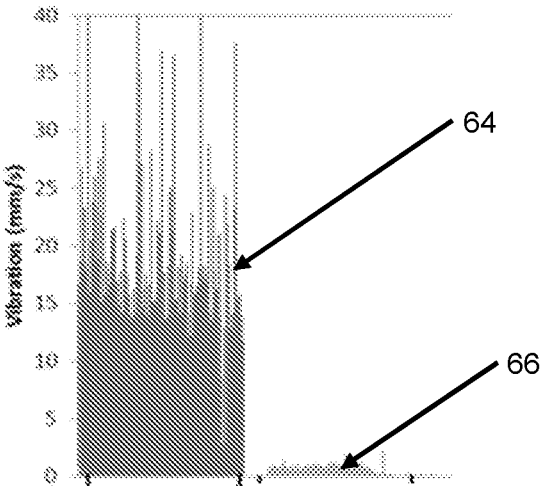
FIG. 13 shows a plot of the level of vibrations actually measured with and without the incorporation of a baffle according to the invention in a DRI moving bed cooler.

Another example of the effectiveness of the invention is shown in FIG. 13, where the level of vibrations actually measured in mm/s during the operation of a DRI cooler, indicated by numeral 64, decreased from levels reaching 40 mm/s to levels of less than 1 mm/s as indicated by numeral 66.

The invention herein described and claimed is a cost-competitive and effective method and apparatus to decrease vibrations, such as quaking and shaking as well as noise effects, known also as hooting, honking or howling, during the discharge of granular materials from silos, hoppers, bins, reactors and in general containers for storing or processing such granular material particles.

It is of course to be understood that the invention has been specified in detail only with respect to certain preferred embodiments thereof, and that a number of modifications and variations can be made without departing from the spirit and scope of the invention which is defined by the following claims.

The invention claimed is:

1. A container for storing or processing granular material particles configured to suppress vibrations, shaking, quaking and/or noise during discharge of a bed of said granular material particles through at least one outlet, the container comprising:

a tapered discharge part including an inner wall converging towards a bottom opening and towards said at least one outlet; and at least one baffle located proximate to and/or at a bottom region of said tapered discharge part, said at least one baffle protrudes into said bed of granular material particles and is configured to form a stagnant zone in said bed above said bottom opening, said at least one baffle is fixed to the inner wall of the tapered discharge part, and the at least one baffle includes a baffle opening through which flows said granular material particles and said at least one baffle is a monolithic annular plate having the baffle opening, wherein said baffle opening has an area in cross section smaller than an area in cross section of the tapered discharge part where the at least one baffle is located and smaller than an area in cross section of the tapered discharge part below said baffle or smaller than an area in cross section of a discharge conduit connected to said discharge outlet, wherein said inner wall of the tapered discharge part is a conical inner wall and the inner wall is continuous from an upper edge of the tapered discharge part to the bottom opening;

wherein the inner wall is configured to remain stationary and not rotate while the granular material particles flow through the bottom opening, and wherein a ratio of a diameter of said baffle opening to a diameter of the cross section of the tapered discharge part at the point where the at least one baffle is located is in a range of 0.5 to 0.95.

2. The container according to claim 1, wherein the monolithic annular plate has an upper planar surface oriented in a horizontal plane extending around a circumference of the annular plate.

3. The container according to claim 1, wherein said at least one baffle includes a plurality of annular segments each separated from the other annular segments, and the annular segments each have an upper planar surface aligned with a horizontal plane common to the upper planar surfaces for all of the annular segments.

4. The container according to claim 1, wherein the at least one baffle is a circular baffle oriented in a horizontal plane, and the baffle opening is a circle and has a diameter larger than the bottom opening of the tapered discharge part.

5. The container according to claim 1, wherein the baffle opening is centered with respect to a vertical axis of the inner wall.

6. The container according to claim 1, wherein said at least one baffle includes a baffle located at a bottom of the tapered discharge part of the container.

7. The container according to claim 1, wherein said at least one baffle includes a baffle located within a lower half portion of the tapered discharge part of the container.

8. The container according to claim 1, wherein the at least one baffle is a plurality of baffles each attached to the tapered discharge part of the container and each of the plurality of baffles is at an elevation in the tapered discharge part different from the elevations for the other baffles.

9. The container according to claim 1, further comprising a discharge rate regulating device.

10. The container according to claim 1, wherein the container is a direct reduced iron (DRI) cooler.

11. The container according to claim 1, wherein said container is a shaft-type reactor for producing direct reduced iron (DRI).

12. The container according to claim 1, wherein said at least one baffle protrudes inwardly from the inner wall in a direction towards a central axis of the tapered discharge part, wherein an upper surface of the at least one baffle is horizontal and forms a ring, and wherein the bed of granular material particles flowing down to the at least one outlet extends upwardly to cover a zone of the bed where friction between the granular material particles and the inner wall of the tapered discharge part causes shaking or quaking of the container.

13. The container according to claim 1, wherein a width of said at least one baffle protruding inside the bed of granular material particles is 10 to 100 times an average size of said granular material particles.

14. A container for storage or processing of granular material particles, the container having a tapered discharge part with a lower discharge opening, the container including a device to decrease vibrations, shaking, quaking and/or noise of the container, the device comprising:

a baffle including a baffle opening configured to allow a flow of said granular material particles, wherein the baffle is a monolithic annular plate having said baffle opening and said baffle opening has an area in cross section smaller than an area of a cross section of a tapered discharge part of the container where the baffle is located and smaller than an area of a cross section of the tapered discharge part below said baffle, or smaller than a cross section area of a discharge conduit connected to said lower discharge outlet, wherein the baffle is configured to form a stagnant zone of the granular material, wherein the stagnant zone is above the baffle and adjacent an internal surface of a wall of the tapered discharge part, wherein the baffle is ring shaped, aligned with a horizontal plane and fixed to an internal surface of the wall of the tapered discharge part of the container, wherein the baffle opening follows the contour and has the same shape as a perimeter of the internal surface of the wall where the baffle is located and a diameter of the baffle opening is larger than a diameter of the lower discharge opening of the tapered discharge part, wherein the wall of the tapered discharge part is continuous from an upper edge of the tapered discharge part to the discharge outlet, and wherein the wall is configured to be stationary and not rotate while the granular material particles flow through the lower discharge opening.

15. The device according to claim 14, wherein said baffle is a plurality of annular segments each separated by a space from an adjacent one of the annular segments.

16. The device according to claim 14, wherein the baffle opening of the baffle is circular.

17. A container for storage or processing of granular material particles, the container including a stationary tapered discharge part and a device configured to decrease vibrations, shaking, quaking and/or noise of the container, the device comprises:

a first baffle including a first baffle opening configured to allow a flow of said granular material particles, wherein the first baffle is a first monolithic annular plate having the first baffle opening and said first baffle opening has an area in cross section smaller than an area of a cross section of the tapered discharge part of the container where the first baffle is located and smaller than an area of a cross section of the stationary tapered discharge part below said first baffle or smaller than a cross section area of a discharge conduit connected to said discharge outlet, wherein the first baffle is at or above the discharge outlet of the stationary tapered discharge part, and a second baffle in the stationary tapered discharge part above the discharge outlet and the first baffle wherein the second baffle is a second monolithic annular plate having a second baffle opening, wherein the first and second baffles are fixed to an internal surface of a wall of the stationary tapered discharge part and each of the first and second baffles configured to form a respective stagnant zone of the granular material particles adjacent the internal surface of the wall, wherein the first baffle is at a first elevation of the stationary tapered discharge part and extends around the stationary tapered discharge part at the first elevation;

wherein the second baffle is at a second elevation of the stationary tapered discharge part and extends around the stationary tapered discharge part at the second elevation;

wherein the second elevation is above the first elevation;

wherein the wall is a continuous wall from an upper edge of the stationary tapered discharge part to the discharge outlet, and wherein the wall is configured to remain stationary and not rotate while the granular material is discharged from an outlet of the stationary tapered discharge part.

18. The container according to claim 17, wherein each of said first and second baffles has a plurality of annular segments each separated a space from an adjacent one of the annular segments.

19. The container according to claim 17, wherein each of the first and second baffle openings is circular.

20. The container according to claim 1, wherein the inner wall of the tapered discharge part is a stationary continuous wall extending from an uppermost edge of the tapered discharge part to a lowermost edge of the tapered discharge part.

21. The container according to claim 14, wherein the wall of the tapered discharge part is a stationary continuous wall extending from an uppermost edge of the tapered discharge part to a lowermost edge of the tapered discharge part.

* * * * *